United States Patent [19]

Sawyer

[11] Patent Number: 4,688,390

[45] Date of Patent: Aug. 25, 1987

[54] REFRIGERANT CONTROL FOR MULTIPLE HEAT EXCHANGERS

[75] Inventor: George N. Sawyer, Flint, Tex.

[73] Assignee: American Standard Inc., New York, N.Y.

[21] Appl. No.: 866,679

[22] Filed: May 27, 1986

[51] Int. Cl.[4] ..... F25B 13/00; F25B 41/00

[52] U.S. Cl. ..... 62/160; 62/197; 62/205; 62/324.6

[58] Field of Search ..... 62/160, 199, 200, 205, 62/204, 206, 324.1, 324.6, 197

[56] References Cited

U.S. PATENT DOCUMENTS

| | | | |
|---|---|---|---|
| 3,232,073 | 2/1966 | Jobes et al. | 62/160 X |
| 3,478,534 | 11/1969 | Matthies | 62/225 |
| 3,916,638 | 11/1975 | Schmidt | 62/238 |
| 3,994,142 | 11/1976 | Kramer | 62/117 |
| 4,017,286 | 4/1977 | English et al. | 62/160 |
| 4,299,098 | 11/1981 | Derosier | 62/238 |
| 4,307,576 | 12/1981 | Takano et al. | 62/204 |
| 4,399,664 | 8/1983 | Derosier | 62/238 |
| 4,528,822 | 7/1985 | Glamm | 62/238 |

FOREIGN PATENT DOCUMENTS

| | | | |
|---|---|---|---|
| 0020642 | 2/1978 | Japan | 62/160 |
| 0111555 | 9/1978 | Japan | 62/324.6 |
| 0050137 | 4/1979 | Japan | 62/160 |
| 0054438 | 4/1979 | Japan | 62/324.6 |
| 0131335 | 10/1979 | Japan | 62/160 |
| 0142851 | 11/1979 | Japan | 62/324.6 |

*Primary Examiner*—Harry B. Tanner

*Attorney, Agent, or Firm*—William J. Beres; Robert J. Harter

[57] ABSTRACT

In a heat pump system for selectively heating or cooling a plurality of zones with a corresponding plurality of zone heat exchangers, the subject invention is used for preventing refrigerant condensate from flooding any inactive heat exchangers. Each zone heat exchanger is typically connected to both a liquid line and a gas line for passing refrigerant therethrough. The invention includes an arrangement of valves disposed only on the liquid line of each zone heat exchanger and eliminates the need for an additional shut-off valve on the gas line. When the heat pump system operates in the cooling mode, each zone heat exchanger functions as an evaporator with the invention operating as an expansion valve, regulating the refrigerant flow entering the heat exchanger to meet the temperature conditioning demand. In the heating mode each zone heat exchanger functions as a condenser and the invention conducts the flow of refrigerant leaving each zone heat exchanger to allow a flow therethrough that enables its corresponding zone heat exchanger to meet its heating demand. When the demand for heat in a zone is satisfied, the heat exchanger associated with that zone becomes inactive and the flow therefrom is restricted to a minimum level sufficient to prevent flooding thereof.

31 Claims, 9 Drawing Figures

REFRIGERANT CONTROL FOR MULTIPLE HEAT EXCHANGERS

TECHNICAL FIELD

This invention generally pertains to a heat pump system having a plurality of zone heat exchangers and specifically to an apparatus and a method for preventing liquid refrigerant from flooding any inactive zone heat exchangers used in such a system.

BACKGROUND OF THE INVENTION

Independently heating or cooling several zones can be accomplished with a heat pump system having a plurality of zone heat exchangers, each operable as a condenser in the heating mode and as an evaporator in the cooling mode. In such a system, each zone heat exchanger is connected to both a gas line and a liquid line for passing refrigerant therethrough. The gas lines are connected to a common gas line manifold and each liquid line, which usually includes an expansion valve, is connected to a common liquid line manifold. Typically, the system also includes an outdoor heat exchanger that functions as an evaporator in the heating mode and a condenser in the cooling mode.

In the cooling mode, refrigerant supplied by a compressor passes in turn through the outdoor heat exchanger (giving up the heat of compression to ambient air), bypasses an outdoor expansion valve, enters the liquid line manifold, and passes through each liquid line. The refrigerant passes through the indoor or zone expansion valves and expands upon entering the zone heat exchangers, where it absorbs heat from zone air as the refrigerant vaporizes. The flow exits the zone heat exchangers through the gas lines, enters the gas line manifold, and returns to the compressor, completing the cycle.

In the heating mode, the flow is reversed, however, the zone expansion valves are now bypassed and the outdoor expansion valve becomes active. Furthermore, the zone heat exchangers provide heat to the zone air while the outdoor heat exchanger absorbs heat from the ambient air.

When the temperature conditioning demand is satisfied, the appropriate zone heat exchanger is deactivated by closing off the refrigerant flowing therethrough. This poses no problem in the cooling mode, because the expansion valve on the liquid line can stop the flow entering the heat exchangers. Any liquid refrigerant inside the inactive heat exchanger will vaporize as it is exposed to the compressor suction pressure through the gas line and gas line manifold.

However, deactivating a heat exchanger during the heating mode poses a problem. When only the zone expansion valve or a liquid line solenoid valve is used to stop the flow, vaporized refrigerant will condense and eventually accumulate to a point where it floods the inactive heat exchanger. This deprives the remaining active system of the refrigerant needed to function properly.

It is possible to solve this problem with an upstream valve on the gas line of each zone heat exchanger. But these valves, being disposed on the inherently large diameter gas lines, must also be relatively large and therefore, more expensive and prone to leak. In addition, the pressure drop across valves used for this purpose is typically less than 30 psi which makes it even more difficult to obtain a positive seal. Nevertheless, this method as disclosed in U.S. Pat. Nos. 3,916,638; 4,299,098; and 4,399,664 is still used.

Another solution, as described in U.S. Pat. Nos. 3,994,142 and 4,528,822 includes a large refrigerant holding reservoir relied upon to maintain a sufficient refrigerant charge in the system. Although appropriate in large systems, its complexity and cost make this method impractical in smaller systems.

In view of the above, it is an object of this invention to provide a relatively simple and inexpensive method of preventing flooding of an inactive heat exchanger that is interconnected in parallel with a plurality of other heat exchangers.

Another object is to deactivate a zone heat exchanger without using a valve on the heat exchanger's gas line.

A further object is to maintain a sufficient refrigerant charge, without using a holding reservoir, to enable proper operation of a heat pump system having a plurality of independently activated zone heat exchangers.

These and other objects will be apparent from the attached drawings and the description of the preferred embodiments that follow below.

DISCLOSURE OF THE INVENTION

In a refrigerant heat pump system selectively operable in a heating or cooling mode and used for independently temperature conditioning a plurality of zones with a plurality of zone heat exchangers, the subject invention is a method and apparatus for regulating the flow of refrigerant through the zone heat exchangers. It is responsive to the selected mode of system operation and the temperature conditioning load applied to the individual zones and is operative to:

1. Allow refrigerant to flow into the heat exchangers at a rate that meets their applied load during the cooling mode.

2. Conduct refrigerant from the heat exchangers at a rate that meets their applied load during the heating mode.

3. Drain refrigerant condensate from the heat exchangers which are not subjected to a load during the heating mode.

DESCRIPTION OF THE PREFERRED EMBODIMENTS

Figure 1:
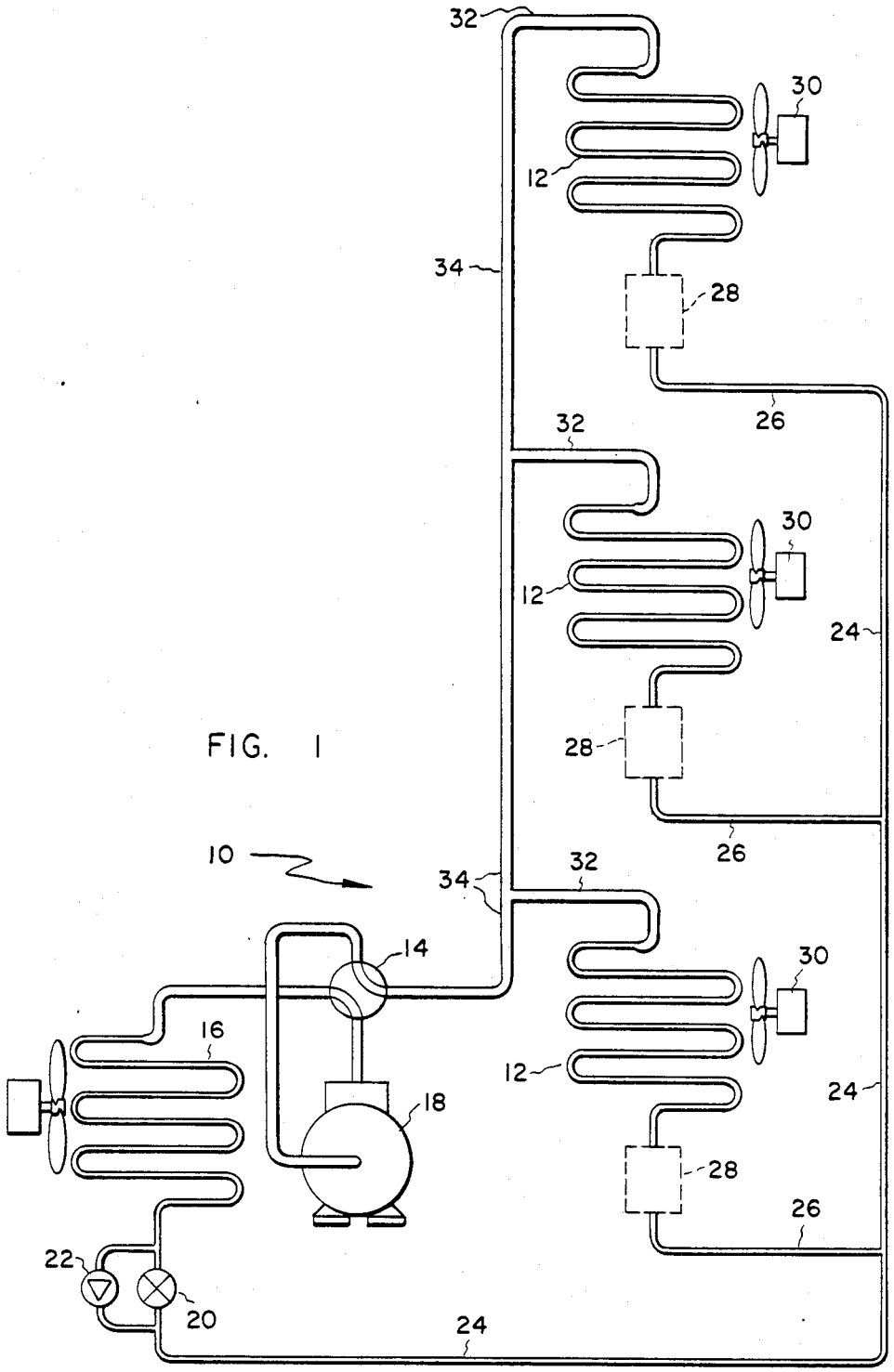
FIG. 1 is a schematic diagram of the heat pump system.

Referring to FIG. 1, refrigerant heat pump system 10 is selectively operative in a heating or cooling mode for independently temperature conditioning a plurality of zones with a corresponding plurality of zone heat exchangers 12. System 10 is shown in the cooling mode wherein refrigerant discharged from compressor 18 is directed by valve 14 into outdoor heat exchanger 16. Having been compressed, the refrigerant is hot and transfers its heat to the outdoor air as it condenses within heat exchanger 16, which thus functions as a condenser. The condensed refrigerant bypasses expansion valve 20 through check valve 22, and enters liquid line manifold 24. The flow passes through liquid lines 26 and is regulated by refrigerant flow restricting means 28 before entering the lower end of heat exchangers 12. Flow restricting means 28 can have a variety of configurations and the details of these configurations and of their operation will be covered later in this description of the preferred embodiments. Flow restricting means 28 produce the pressure drop needed to enable heat exchangers 12 to function as evaporators which vaporize the refrigerant. Warm zone air, circulated across heat exchangers 12 by fans 30, is cooled by the vaporizing refrigerant. The refrigerant vapor enters gas lines 32, and passes in series flow through gas line manifold 34, through valve 14, and returns to the suction inlet of compressor 18, completing the cycle.

When a zone heat exchanger 12 is not subjected to a temperature conditioning demand during the cooling mode, the refrigerant flow therethrough is stopped substantially by flow restricting means 28, thereby rendering the unloaded heat exchanger 12 inactive. Any liquid refrigerant inside inactive heat exchanger 12 will vaporize as it is exposed to the low pressure side of compressor 18 through gas line 32, manifold 34, and valve 14.

To operate in the heating mode, valve 14 is turned 90° from the position shown in FIG. 1. This causes hot compressed refrigerant discharged from compressor 18 to be directed into gas line manifold 34 by valve 14. From manifold 34, the flow passes through gas lines 32 and into heat exchangers 12. Heat exchangers 12 each function as a condenser heating their respective zone as the hot refrigerant condenses in heat transfer with zone air. The refrigerant flow continues downwardly and leaves heat exchangers 12 through flow restricting means 28. The refrigerant passes in series flow through liquid lines 26, through liquid manifold 24, through expansion valve 20, and then vaporizes in outdoor heat exchanger 16. The pressure drop across expansion valve 20 and the heat transfer with ambient air provided by outdoor heat exchanger 16 functioning as an evaporator vaporizes the refrigerant. The refrigerant leaves heat exchanger 16 and is directed by valve 14 back into the suction line of compressor 18, thereby completing the heating cycle.

Figure 3:
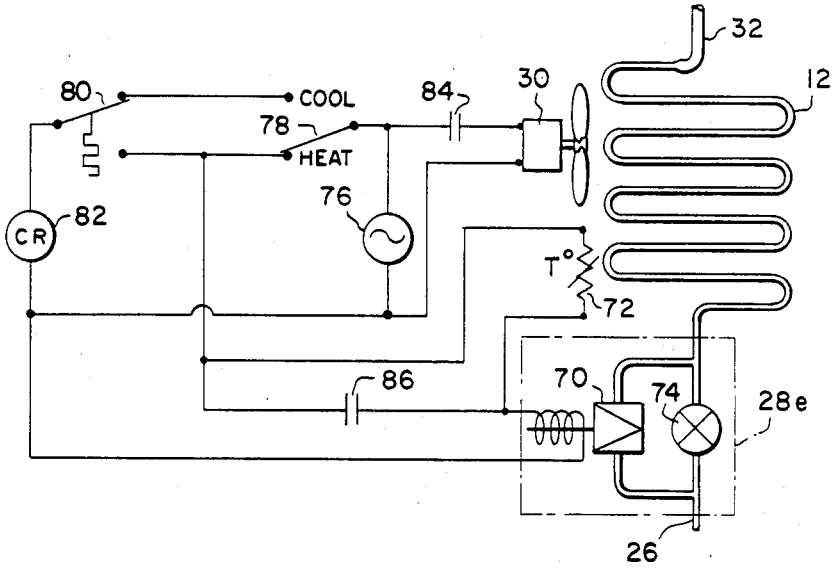
FIG. 3 is a schematic wiring diagram associated with control of the flow restricting means of FIG. 2*e*.

During the heating mode, heat exchanger 12 is deactivated when its zone temperature setpoint is met and its corresponding fan 30 is turned off. A thermostat similar to temperature sensor 80 of FIG. 3 determines when the setpoint is met and disables fan 30 accordingly. When deactivated, the heat output of heat exchanger 12 is minimized as the refrigerant flowing therefrom is substantially restricted by flow restricting means 28. In addition, depending on its configuration, flow restricting means 28 either continuously or intermittently drains the refrigerant condensate from the inactive heat exchanger 12 through the appropriate liquid line 26.

Although the configuration of refrigerant flow restricting means 28 may vary as shown by the various embodiments associated with reference numbers 28*a–g* in FIGS. 2*a–g*, their function remains essentially the same, and each is operative in the following modes:

(1) cooling mode/zone heat exchanger active
(2) cooling mode/zone heat exchanger inactive
(3) heating mode/zone heat exchanger active
(4) heating mode/zone heat exchanger inactive.

The method of operation is chosen based on the temperature of the zones to be conditioned and the desired setpoint temperature of these zones.

Figure 2A:
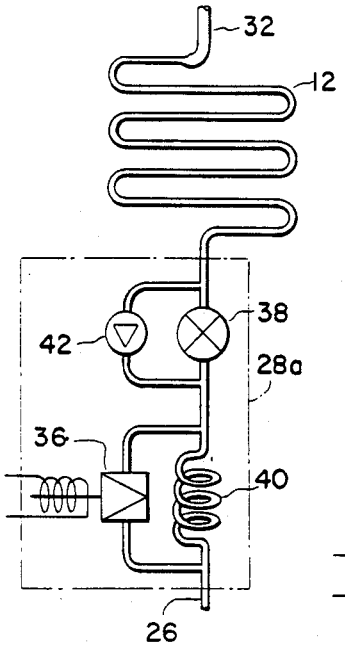
FIGS. 2*a*–2*g* are schematic diagrams each illustrating an embodiment of the flow restricting means.

The flow direction through flow restricting means 28 (for each embodiment 28*a–*28*g*) is as follows:

FIG. 2*a*, cooling mode/heat exchanger active—the refrigerant enters through the bottom of heat exchanger 12 in series flow through an electronic valve means such as open solenoid valve 36 and then through expansion valve 38. Expansion valve 38 produces the pressure drop needed to vaporize the refrigerant, thereby enabling heat exchanger 12 to cool zone air.

FIG. 2*a*, cooling mode/heat exchanger inactive—solenoid valve 36 closes and the refrigerant flowing upwardly into heat exchanger 12 is not only restricted by expansion valve 38, but is also restricted by series connected capillary tube 40. Expansion valve 38 can shut the flow off completely, or if it is desirable to keep heat exchanger 12 slightly cool, it can allow some refrigerant to pass.

FIG. 2*a*, heating mode/heat exchanger active—hot refrigerant enters heat exchanger 12 through gas line 32 and leaves substantially unrestricted in succession through check valve 42 and open solenoid valve 36.

FIG. 2*a*, heating mode/heat exchanger inactive—solenoid valve 36 closes and refrigerant condensate drains from heat exchanger 12 in series flow through check valve 42 and capillary tube 40. The restriction of capillary tube 40 is selected to allow a flow rate that is minimally greater than the rate of condensation in heat exchanger 12. It should be noted that expansion valve 38 and capillary tube 40 are only two examples of a variety of expansion or flow limiting devices that can be used and that an orifice could also perform the same function.

Figure 2B:
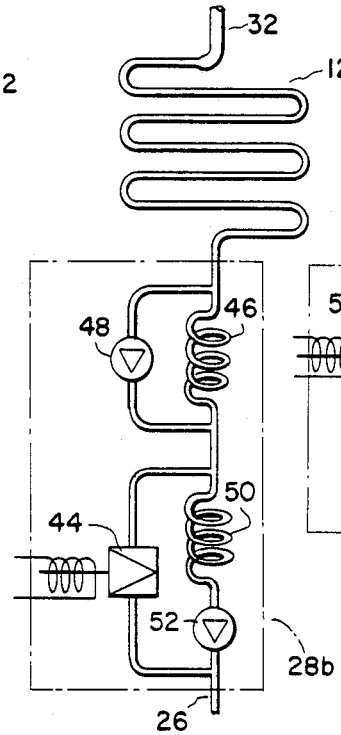

FIG. 2*b*, cooling mode/heat exchanger active—refrigerant flows upwardly through an electronic valve means such as open solenoid valve 44 and then is restricted by capillary 46 before entering heat exchanger 12. Capillary 46 produces the pressure drop necessary to vaporize the refrigerant which enables heat exchanger 12 to cool zone air.

FIG. 2*b*, cooling mode/heat exchanger inactive—refrigerant in liquid line 26 is prevented from moving upwardly into heat exchanger 12 by closed solenoid valve 44 and check valve 52. Any liquid refrigerant inside heat exchanger 12 vaporizes as it is exposed to the suction line pressure of compressor 18 through gas line 32, manifold 34, and valve 14.

FIG. 2*b*, heating mode/heat exchanger active—hot refrigerant moves downwardly through heat exchanger 12 and passes substantially unrestricted in series flow through check valve 48 and open solenoid valve 44.

FIG. 2*b*, heating mode/heat exchanger inactive—solenoid valve 44 closes which significantly reduces the flow of refrigerant leaving heat exchanger 12. The flow is now limited to that which may leave in series flow through check valve 48, capillary tube 50, and check valve 52. Flooding of heat exchanger 12 is prevented as capillary tube 50 provides a flow rate that is minimally greater than the rate of condensation inside heat exchanger 12. It should be appreciated that capillary tubes 46 and 50 are just one example of an expansion or flow limiting device and other devices such as an expansion valve or an orifice could also be used.

Figure 2C:
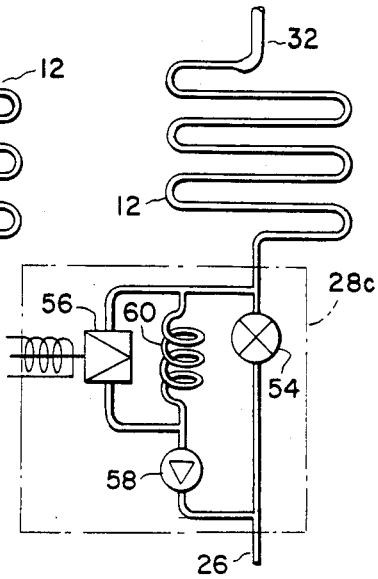
Figure 2D:
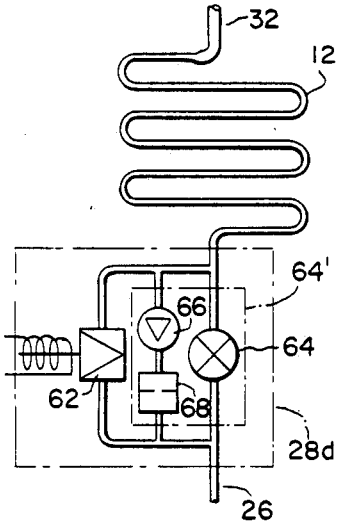
Figure 2E:
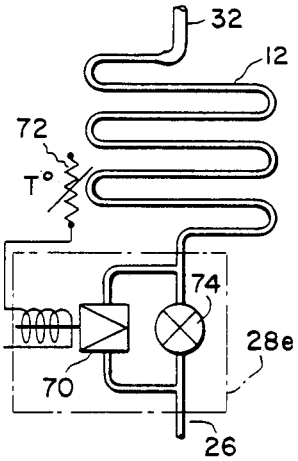

FIG. 2*c*, cooling mode/heat exchanger active—the refrigerant from liquid line 26 flows upwardly through expansion valve 54 and into heat exchanger 12. Expansion valve 54 produces the pressure drop needed to vaporize the refrigerant as it cools zone air passing through heat exchanger 12.

FIG. 2*c*, cooling mode/heat exchanger inactive—expansion valve 54 closes substantially and either prevents any refrigerant in liquid line 26 from entering heat exchanger 12 or, if desired, allows just enough refrigerant to pass to keep heat exchanger 12 cool when its corresponding fan 30 is off. Any liquid refrigerant inside heat exchanger 12 vaporizes as it is exposed to the suction line pressure of compressor 18.

FIG. *2c*, heating mode/heat exchanger active—hot refrigerant passes downwardly through heat exchanger 12 and leaves substantially unrestricted in series flow through open solenoid valve 56 and check valve 58.

FIG. *2c*, heating mode/heat exchanger inactive—solenoid valve 56 closes, which limits the refrigerant flowing from heat exchanger 12 to that which drains in series flow through capillary tube 60 and check valve 58. Flooding is prevented by providing a flow rate that is minimally greater than the rate of condensation inside heat exchanger 12. Capillary tube 60 is one example of an expansion or flow limiting device and it should be noted that other alternatives such as an orifice could also be used.

FIG. *2d*, cooling mode/heat exchanger active—solenoid valve 62 closes and refrigerant flows upwardly through expansion valve 64 and into heat exchanger 12. Expansion valve 64 produces the pressure drop needed to vaporize the refrigerant which cools heat exchanger 12.

FIG. *2d*, cooling mode/heat exchanger inactive—both solenoid valve 62 and expansion valve 64 close and together with check valve 66, substantially prevent refrigerant in liquid line 26 from entering heat exchanger 12. If limited cooling is desired, check valve 66 can be eliminated, thereby allowing a restricted refrigerant flow into heat exchanger 12 through orifice 68. Any liquid refrigerant inside heat exchanger 12 vaporizes as it is exposed to the suction line pressure of compressor 18.

FIG. *2d*, heating mode/heat exchanger active—hot refrigerant passes downwardly through heat exchanger 12 and leaves substantially unrestricted through open solenoid valve 62.

FIG. *2d*, heating mode/heat exchanger inactive—both solenoid valve 62 and expansion valve 64 close and thus the refrigerant can only drain from heat exchanger 12 in series flow through check valve 66 and orifice 68. To avoid flooding, the size of orifice 68 is selected to enable a flow that is minimally above the rate of condensation inside heat exchanger 12. It should be noted that expansion valve 64 could integrally include check valve 66 and orifice 68 as represented by expansion valve 64'. It should also be appreciated that orifice 68 is only one example of a flow restrictor and a capillary tube is an equally acceptable alternative.

FIG. *2e*, cooling mode/heat exchanger active—solenoid valve 70 closes in the cooling mode regardless of the status of thermistor 72 and refrigerant flows upwardly through expansion valve 74 and into heat exchanger 12. Expansion valve 74 produces the pressure drop needed to vaporize the refrigerant which cools the zone air passing through heat exchanger 12.

FIG. *2e*, cooling mode/heat exchanger inactive—solenoid valve 70 and expansion valve 74 close and substantially prevent refrigerant in liquid line 26 from entering heat exchanger 12. Any liquid refrigerant inside heat exchanger 12 vaporizes as it is exposed to the suction line pressure of compressor 18.

FIG. *2e*, heating mode/heat exchanger active—when heat exchanger 12 is active during the heating mode, solenoid valve 70 opens regardless of the status of thermistor 72. This allows hot refrigerant to pass downwardly, substantially unrestricted through heat exchanger 12 and open solenoid valve 70.

FIG. *2e*, heating mode/heat exchanger inactive—expansion valve 74 closes and the operation of solenoid valve 70 is controlled by thermistor 72. Thermistor 72, functioning as a float switch disposed near the bottom of heat exchanger 12, is electrically connected in series with solenoid valve 70. Thermistor 72 has a positive temperature coefficient (its resistance increases with temperature) and when it is in heat exchange relationship with vaporous refrigerant, its electrical resistance increases due to self-heating. The relatively high resistance reduces the current below the level at which solenoid valve 70 opens. With both solenoid valve 70 and expansion valve 74 closed, substantially no refrigerant drains from heat exchanger 12 and thus refrigerant condensate accumulates therewithin. When the condensate rises to the level of thermistor 72, the temperature of thermistor 72 decreases as it transfers heat to *liquid* refrigerant in heat exchanger 12 which has a greater heat absorbing capacity than vapor. As a result, the resistance of thermistor 72 drops, causing an increase in current which actuates solenoid valve 70 to an open condition. This allows condensate to drain from heat exchanger 12 through open solenoid valve 70. When the condensate level drops and thermistor 72 is once again in heat exchange relationship with vaporous refrigerant, the electrical current decreases and solenoid valve 70 closes. This cycle repeats, thereby minimizing the flow of refrigerant through heat exchanger 12 while preventing flooding thereof.

There are many possible control means that would allow refrigerant flow restricting means **28*e* to operate as described above. One example is the circuit show in FIG. 3. This circuit includes power supply 76, fan 30, mode selector switch 78, zone temperature sensor 80, thermistor 72, normally closed solenoid valve 70, and relay 82 with its two normally open contacts 84 and 86. Thermistor 72 is used as a liquid level sensing means, but a variety of alternatives could also be used such as, a float switch (not shown) or a temperature switch (not shown). With circuit modifications a thermocouple (not shown) could also be adapted to function as a liquid level sensor. It should also be noted that expansion valve 74** can be either electrically or thermally actuated.

FIG. *2f*, cooling mode/heat exchanger active—when heat exchanger 12 is active during the cooling mode, solenoid valve 88 remains open regardless of the status of thermistor 90. This allows refrigerant to flow upwardly in series flow through open solenoid valve 88 and capillary tube 92 into heat exchanger 12. Capillary 92 produces the pressure drop needed to vaporize the refrigerant which cools the zone air passing through heat exchanger 12.

FIG. *2f*, cooling mode/heat exchanger inactive—regardless of the status of thermistor 90, solenoid valve 88 closes and substantially prevents refrigerant in liquid line 26 from entering heat exchanger 12. Any liquid refrigerant inside heat exchanger 12 vaporizes as it is exposed to the suction line pressure of compressor 18.

FIG. *2f*, heating mode/heat exchanger active—solenoid valve 88 opens and hot refrigerant flows downwardly through heat exchanger 12 and out, substantially unrestricted in series flow through check valve 94 and open solenoid valve 88.

Figure 2F:
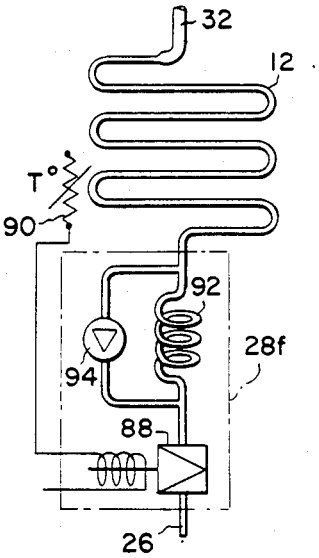

FIG. 2*f*, heating mode/heat exchanger inactive—the operation of normally closed solenoid valve 88 is controlled by thermistor 90 which is electrically connected in series therewith. Thermistor 90 has a positive temperature coefficient and is self-heated by current passing therethrough. When thermistor 90 is in heat exchange relationship with the vaporous refrigerant that enters heat exchanger 12 through gas line 32, the temperature of thermistor 90 rises due to self-heating. This causes the resistance of thermistor 90 to become high enough to prevent sufficient current from holding solenoid valve 88 open. Thus solenoid valve 88 closes and prevents the refrigerant inside heat exchanger 12 from draining. As the hot refrigerant gives-up heat and condenses inside heat exchanger 12, the level of condensate rises to the level of thermistor 90. This causes the temperature of thermistor 90 to decrease as it is in heat exchange relationship with liquid refrigerant. As the temperature decreases, the resistance decreases and the current increases which opens solenoid valve 88 and drains the condensate from heat exchanger 12. When the level of the condensate drops and thermistor 90 is once again in heat exchange relationship with vaporous refrigerant, solenoid valve 88 closes again. This repetitive cycle minimizes the flow of refrigerant through heat exchanger 12 while preventing flooding thereof.

It should be appreciated that capillary tube 92 is only one example of an expansion or flow limiting device and other devices such as an orifice or an expansion valve would work just as well.

Figure 2G:
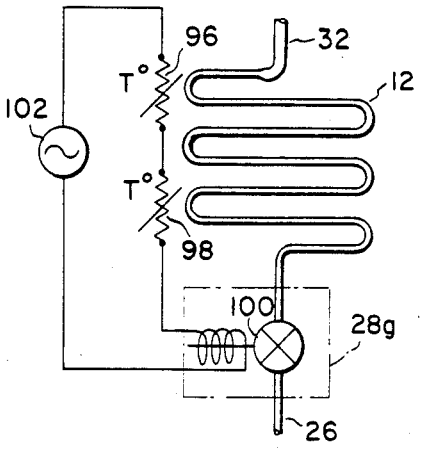

Referring to FIG. 2*g*, in general, thermistor 96 and 98 control the operation of electronic expansion valve 100 which opens as the current passing through it increases. Power supply 102 delivers current through thermistors 96, 98 and expansion valve 100 which are connected in series. Both thermistors 96 and 98 are thermally coupled to heat exchanger 12, with thermistor 98 being disposed near the bottom thereof and thermistor 96 near the top. Thermistor 98, having a positive temperature coefficient, has a resistance that increases with temperature, while thermistor 96, having a negative temperature coefficient, has a resistance that decreases with temperature. Both thermistors 96 and 98 are self-heated by the current passing through them, therefore, the resistance of thermistor 96 is normally low and the resistance of thermistor 98 is normally high.

FIG. 2*g*, cooling mode/heat exchanger active—refrigerant flows upwardly through expansion valve 100 and into heat exchanger 12. Expansion valve 100 produces the pressure drop needed to vaporize the refrigerant which provides the cooling effect of heat exchanger 12. When thermistor 98 is cooled by the refrigerant, its resistance becomes negligible and the current for opening expansion valve 100 is primarily regulated by thermistor 96. If desired, thermistor 98 can be electrically bypassed during the cooling mode, to be sure it doesn't interfere with the control of expansion valve 100. When the cooling demand on heat exchanger 12 increases, the temperature of thermistor 96 will increase accordingly, which in turn, decreases its resistance. The lower resistance increases the current to a level which is sufficient to open expansion valve 100 and causes an increase in refrigerant flow for meeting the cooling demand. The control becomes self-regulating as the increased flow cools thermistor 96.

FIG. 2*g*, cooling mode/heat exchanger inactive—in the inactive state, e.g., the zone temperature set point has been met and fan 30 is off, heat exchanger 12 and expansion means **28*g* continue to function in a manner similar to their operation when active in the cooling mode. However, with substantially no cooling demand on heat exchanger 12, only a small amount of refrigerant flow is required to maintain the desired temperature of heat exchanger 12 and thus expansion valve 100** closes substantially.

FIG. 2*g*, heating mode/heat exchanger active—hot refrigerant entering from gas line 32 and moving downwardly through heat exchanger 12 not only heats the zone air but also raises the temperature of thermistors 96 and 98. This causes the resistance of thermistor 96 to become negligible and causes the resistance of thermistor 98 to become so large that expansion valve 100 closes substantially. The refrigerant, in the process of heating the circulated zone air, condenses at a rate proportional to the load applied to heat exchanger 12. When the level of condensate rises to the level of thermistor 98, the temperature of thermistor 98 decreases as it transfers heat to the liquid refrigerant. This decreases the resistance of thermistor 98, increases the current, and opens valve 100 which drains the condensate. As the condensate level drops, thermistor 98 is once again in heat exchange relationship with vaporous refrigerant, thereby raising its resistance and causing expansion valve 100 to close. As this cycle repeats, heat exchanger 12 substantially fills with hot refrigerant vapor and any accumulation of refrigerant condensate intermittently drains from the bottom of heat exchanger 12 through expansion valve 100.

FIG. 2*g*, heating mode/heat exchanger inactive—expansion means **28*g* continues to cycle as if it were active in the heating mode. However, the heat given off by heat exchanger 12 is reduced in accordance with the lower heating demand. This reduces the rate of condensation within heat exchanger 12. As a result, both the open/close cycling rate of valve 100** and the refrigerant flow rate are greatly reduced.

Although this invention is described with respect to several embodiments, none of which has at this time been determined to be preferred over the others, modifications thereto will become apparent to those skilled in the art. Therefore, the scope of this invention is to be determined by reference to the claims which follow.

I claim:

1. In a refrigerant heat pump system selectively operable in either a heating or cooling mode for temperature conditioning a plurality of zones with a corresponding plurality of zone heat exchangers wherein each of the zone heat exchangers functions as an evaporator in the cooling mode and a condenser in the heating mode and each is operable in either an active state for meeting a temperature conditioning demand sensed by a temperature sensor or an inactive state when not subjected to a temperature conditioning demand, a zone heat exchanger control comprising:

a. refrigerant flow restricting means connected at one end of at least one of the zone heat exchangers for regulating the flow of refrigerant therethrough, said flow restricting means allowing refrigerant to enter its corresponding heat exchanger substantially unrestricted when the heat exchanger is inactive during the heating mode and allowing refrigerant to leave its corresponding heat exchanger substantially unrestricted during the cooling mode; and b. control means, responsive to the temperature sensor, for controlling the flow restricting means as a function of both the temperature conditioning demand on its corresponding zone heat exchanger and the selected mode of system operation, such that the flow restricting means:

i. restricts refrigerant flowing into its corresponding zone heat exchanger during the cooling mode, ii. conducts the flow of refrigerant from its corresponding zone heat exchanger to allow a flow therethrough that enables its corresponding zone heat exchanger to meet its temperature conditioning demand during the heating mode, and iii. prevents flooding of its corresponding zone heat exchanger when inactive during the heating mode by allowing refrigerant to flow out of its corresponding zone heat exchanger at an average rate that is minimally greater than the rate of refrigerant condensation therewithin.

2. A heat pump system as recited in claim 1, wherein the control means include liquid level sensing means for sensing the liquid level of refrigerant condensate in at least one of the zone heat exchangers.

3. A heat pump system as recited in claim 1, wherein the liquid level sensing means includes a first thermistor disposed near the bottom of at least one of the zone heat exchangers.

4. A heat pump system as recited in claim 3, wherein the first thermistor has a positive temperature coefficient.

5. A heat pump system as recited in claim 1, wherein the control means include a second thermistor thermally exposed to the temperature of at least one of the zone heat exchangers.

6. A heat pump system as recited in claim 5, wherein the second thermistor has a negative temperature coefficient.

7. A heat pump system as recited in claim 1, wherein the refrigerant flow restricting means include electronic valve means for restricting flow when closed and for providing substantially unrestricted flow when opened.

8. A heat pump system as recited in claim 1, wherein the refrigerant flow restricting means include a first expansion valve.

9. A heat pump system as recited in claim 8, wherein the refrigerant flow restricting means include a second expansion valve.

10. A heat pump system as recited in claim 1, wherein the refrigerant flow restricting means include a first capillary tube.

11. A heat pump system as recited in claim 10, wherein the refrigerant flow restricting means include a second capillary tube.

12. A heat pump system as recited in claim 1, wherein the refrigerant flow restricting means include a first check valve.

13. A heat pump system as recited in claim 12, wherein the refrigerant flow restricting means include a second check valve.

14. In a refrigerant heat pump system selectively operable in either a heating or cooling mode for temperature conditioning a plurality of zones with a corresponding plurality of zone heat exchangers each connected to a liquid line and a gas line for conducting refrigerant therethrough, wherein each of the zone heat exchangers functions as an evaporator in the cooling mode and a condenser in the heating mode and each is operable in either an active state for meeting a temperature conditioning demand sensed by a temperature sensor or an inactive state when not subjected to a temperature conditioning demand, a zone heat exchanger control comprising:

a. refrigerant flow restricting means connected to the liquid line of each of the zone heat exchangers for regulating the flow of refrigerant therethrough, said flow restricting means allowing refrigerant to enter its corresponding heat exchanger substantially unrestricted when the heat exchanger is inactive during the heating mode and allowing refrigerant to leave its corresponding heat exchanger substantially unrestricted during the cooling mode; and b. control means, responsive to the temperature sensor for controlling the flow restricting means as a function of both the temperature conditioning demand on its corresponding zone heat exchanger and the selected mode of system operation, such that the flow restricting means:

i. restricts refrigerant flowing into its corresponding zone heat exchanger during the cooling mode, ii. conducts the flow of refrigerant from its corresponding zone heat exchanger to allow a flow therethrough that enables its corresponding zone heat exchanger to meet its temperature conditioning demand during the heating mode, and iii. prevents flooding of its corresponding inactive zone heat exchanger during the heating mode by allowing refrigerant to flow out of its corresponding zone heat exchanger at an average rate that is minimally greater than the rate of refrigerant condensation therewithin.

15. A heat pump system as recited in claim 14, wherein the inside diameter of the liquid line is smaller than the inside diameter of the gas line.

16. A heat pump system as recited in claim 14, wherein the flow restricting means allow substantially unrestricted flow when its corresponding heat exchanger is active during the heating mode.

17. A heat pump system as recited in claim 14, wherein the control means include liquid level sensing means for sensing the liquid level of refrigerant condensate in at least one of the zone heat exchangers.

18. A heat pump system as recited in claim 14, wherein the liquid level sensing means include a first thermistor disposed near the bottom of at least one of the secondary heat exchangers.

19. A heat pump system as recited in claim 18, wherein the first thermistor has a positive temperature coefficient.

20. A heat pump system as recited in claim 14, wherein the control means include a second thermistor thermally exposed to the temperature of at least one of the zone heat exchangers.

21. A heat pump system as recited in claim 20, wherein the second thermistor has a negative temperature coefficient.

22. A heat pump system as recited in claim 14, wherein the refrigerant flow restricting means include electronic valve means for restricting flow when closed and for providing substantially unrestricted flow when opened.

23. A heat pump system as recited in claim 14, wherein the refrigerant flow restricting means include a first expansion valve.

24. A heat pump system as recited in claim 23, wherein the refrigerant flow restricting means include a second expansion valve.

25. A heat pump system as recited in claim 14, wherein the refrigerant flow restricting means include a first capillary tube.

26. A heat pump system as recited in claim 25, wherein the refrigerant flow restricting means include a second capillary tube.

27. A heat pump system as recited in claim 14, wherein the refrigerant flow restricting means include a first check valve.

28. A heat pump system as recited in claim 27, wherein the refrigerant flow restricting means include a second check valve.

29. In refrigerant heat pump system selectively operable in a heating or cooling mode for temperature conditioning a plurality of zones with a corresponding plurality of zone heat exchangers functioning as evaporators in the cooling mode and condensers in the heating mode, wherein each of the heat exchangers is operative in an active state to meet a temperature conditioning demand and is otherwise inactive when not subjected to a demand, a method of controlling the flow through one of the plurality of zone heat exchangers associated with one zone of the plurality of zones, comprising the steps of:

a. restricting the flow of refrigerant entering said one zone heat exchanger during the cooling mode, thereby vaporizing the refrigerant to enable said one zone heat exchanger to meet the cooling demand;

b. providing a flow path for refrigerant to leave said one zone heat exchanger at a rate that meets the heating demand while the heat exchanger is active during the heating mode;

c. regulating the flow of refrigerant leaving said one zone heat exchanger to an average rate that is minimally greater than the rate of refrigerant condensation inside said one zone heat exchanger when inactive during the heating mode, whereby flooding of said one zone heat exchanger with refrigerant is avoided;

d. allowing refrigerant to enter said one zone heat exchanger substantially unrestricted when the heat exchanger is inactive during the heating mode; and e. allowing refrigerant to leave said one zone heat exchanger substantially unrestricted during the cooling mode.

30. The method as defined by claim 29 further comprising the step of sensing the level of refrigerant condensate inside said one zone heat exchanger.

31. The method as defined by claim 30 wherein the step of sensing the level of condenstate is accomplished using a thermistor.

* * * * *